US009412347B2

(12) United States Patent
Kobayashi

(10) Patent No.: US 9,412,347 B2
(45) Date of Patent: Aug. 9, 2016

(54) DEVICE FOR VIBRATING A STRINGED INSTRUMENT

(71) Applicants: Koji Kobayashi, Tokyo (JP); Shoji Kobayashi, Tokyo (JP)

(72) Inventor: Koji Kobayashi, Tokyo (JP)

(73) Assignees: Koji Kobayashi, Tokyo (JP); Shoji Kobayashi, Tokyo (JP)

( * ) Notice: Subject to any disclaimer, the term of this patent is extended or adjusted under 35 U.S.C. 154(b) by 0 days.

(21) Appl. No.: 14/896,442

(22) PCT Filed: Jun. 6, 2014

(86) PCT No.: PCT/JP2014/003047

§ 371 (c)(1),
(2) Date: Dec. 7, 2015

(87) PCT Pub. No.: WO2014/199613

PCT Pub. Date: Dec. 18, 2014

(65) Prior Publication Data

US 2016/0140941 A1 May 19, 2016

(30) Foreign Application Priority Data

Jun. 10, 2013 (JP) ..... 2013-121936

(51) Int. Cl.
*G10H 3/00* (2006.01)
*G10F 1/16* (2006.01)
(Continued)

(52) U.S. Cl.
CPC .. *G10F 1/16* (2013.01); *G10D 3/04* (2013.01); *G10F 5/02* (2013.01); *H04R 1/24* (2013.01)

(58) Field of Classification Search
CPC ..... G10H 2220/525; G10H 3/26; G10F 1/16; G10F 5/02; G10D 3/04; H04R 1/24
USPC ..... 84/723
See application file for complete search history.

(56) References Cited

U.S. PATENT DOCUMENTS 4,075,921 A * 2/1978 Heet ..... G10H 3/26 84/738
4,245,540 A * 1/1981 Groupp ..... G10H 3/26 84/726

(Continued)

FOREIGN PATENT DOCUMENTS

JP H09247779 9/1997
JP H11122687 4/1999

(Continued)

OTHER PUBLICATIONS

Japanese International Search Report PCT/JP2014/003047—PCT/ISA/210, dated Jul. 2009 (3 pages).

(Continued)

*Primary Examiner* — Jeffrey Donels
(74) *Attorney, Agent, or Firm* — Dority & Manning, P.A.

(57) ABSTRACT

Provided is a device (20) for vibrating a string instrument (1) to allow the string instrument to be used as a loudspeaker. To press a base member (22) fitted with a vibration generator (50) against a bridge (13) of the string instrument (1) via a load point member (24) of a vibration transmission member (26), the base member (22) is provided with a fulcrum member (30) engaging an upper side of the strings (9) of the string instrument (1) and an anchor member (38) engaging a lower side of the strings (9). In order to urge the vibration transmission member (26) against the bridge (13), a cam mechanism (40) presses the anchor member (38) against the lower side of the strings (9).

13 Claims, 13 Drawing Sheets

(51) Int. Cl.

| | |
|---|---|
| ***G10D 3/04*** | (2006.01) |
| ***G10F 5/02*** | (2006.01) |
| ***H04R 1/24*** | (2006.01) |

(56) References Cited

U.S. PATENT DOCUMENTS

| | | | | | |
|---|---|---|---|---|---|
| 4,697,491 | A * | 10/1987 | Maloney | G10H 3/18 | 84/723 |
| 4,762,046 | A * | 8/1988 | Aspri | G10K 15/10 | 84/294 |
| 5,056,400 | A * | 10/1991 | Wachi | G10H 3/18 | 84/600 |
| 5,449,858 | A * | 9/1995 | Menning | G10H 3/26 | 84/727 |
| 5,932,827 | A * | 8/1999 | Osborne | G10H 3/18 | 84/726 |
| 6,320,113 | B1 * | 11/2001 | Griffin | G10D 3/00 | 84/738 |
| 7,227,068 | B1 * | 6/2007 | Van Doren | G10D 1/005 | 84/297 R |
| 9,111,517 | B2 * | 8/2015 | Webman | G10H 3/18 | |
| 2006/0117938 | A1 * | 6/2006 | Gillette | G10H 3/185 | 84/723 |
| 2007/0180975 | A1 * | 8/2007 | Paris | G10D 3/02 | 84/291 |
| 2008/0173165 | A1 * | 7/2008 | DeMars | G10H 3/186 | 84/731 |
| 2009/0064853 | A1 * | 3/2009 | Gillette | G10H 3/185 | 84/725 |
| 2011/0192273 | A1 * | 8/2011 | Findley | G10H 1/32 | 84/743 |

FOREIGN PATENT DOCUMENTS

| | | |
|---|---|---|
| JP | 2002539479 | 11/2002 |
| JP | 2008219202 | 9/2008 |
| JP | 2009505137 | 2/2009 |
| JP | 2010136313 | 6/2010 |
| JP | 2011035851 | 2/2011 |

OTHER PUBLICATIONS

Japanese International Search Report—(English Translation) PCT/JP2014/003047—PCT/ISA/210, dated Jul. 2009 (2 pages).

Japanese International Application Form PCT/RO/101, dated Apr. 4, 2014 (4 pages).

* cited by examiner

DEVICE FOR VIBRATING A STRINGED INSTRUMENT

CROSS REFERENCE TO RELATED APPLICATIONS

This application is the U.S. National Stage entry of International Application Number PCT/JP2014/003047 filed under the Patent Cooperation Treaty having a filing date of Jun. 6, 2014, which claims priority to Japanese Patent Application Number JP2013-121936 having a filing date of Jun. 10, 2013, the disclosures of both of which are hereby incorporated by reference herein in their entirety for all purposes.

TECHNICAL FIELD

The present invention relates to a device for vibrating a string instrument, and in particular a device for vibrating a string instrument suitable for using the string instrument as a loudspeaker.

BACKGROUND ART

A number of devices have been proposed over the past years for automatically playing musical instruments. Small music boxes are classical examples, and automatic pianos that play musical pieces according to electronically stored musical score data have come to be widely used. Attempts have been made to automatically play string instruments, but few practical solutions have been proposed because of the complex mechanisms such as robot arms that are required to properly pluck the strings.

It is known to season or age string instruments. When a string instrument is left alone without being played for a prolonged period of time, the instrument may become unable to produce the desired sound quality. Therefore, it is practiced to play a string instrument at a prescribed interval to maintain the string instrument in proper order, and this is called as "seasoning". When a string instrument is freshly manufactured, it may also be unable to produce the intended sound quality. For this reason, the freshly manufactured string instrument is sometimes "aged" or played for a prescribed time period before it is delivered to the buyer of the string instrument. As the work of seasoning and aging is laborious, it has been proposed to cause the strings of string instruments to vibrate by using special powered vibrating devices for the purpose of aging or seasoning the string instruments.

For instance, Patent Document 1 discloses an arrangement in which a vibrating device is attached to a violin via a bridge cradle that can be detachably mounted on the bridge of the violin to vibrate the violin. It is also disclosed to interpose a vibrating device between the soundboard and the strings of a guitar to vibrate the guitar. However, because the force by which the vibrating device is attached to the string instrument is limited, only a low power vibration can be applied to the string instrument. If a high power vibration which is powerful enough to use the string instrument as a loudspeaker is applied to the string instrument, the vibrating device may be caused to rattle, and a desired vibration of the string instrument cannot be achieved. The vibrating device may even be detached from the string instrument during use.

The string instrument itself may be worked upon or modified so as to firmly attach the vibrating device to the string instrument, but this impairs the quality of the string instrument to such an extent as to render the string instrument incapable of producing the expected sound quality and damage the external appearance of the string instrument. Typically, such modification catastrophically depreciates the value of the string instrument.

Patent Document 2 proposes to use a violin as a loudspeaker by modifying the violin itself. The vibrating device is installed inside the violin in such a manner that the vibrating device is required to be installed during the manufacturing of the violin. Thus, the violin is not an ordinary violin from the beginning. A vibrating device could be installed in an existing violin with some effort, but no such undertaking is conceivable if the violin happens to be a costly one.

PRIOR ART REFERENCE(S)

Patent Document(s)

Patent Document 1: JP2009-505137A
Patent Document 2: JP2011-035851A

SUMMARY OF THE INVENTION

Task to be Accomplished by the Invention

In view of such problems of the prior art, a primary object of the present invention is to provide a device for vibrating a string instrument to allow the string instrument to be used as a loudspeaker.

A second object of the present invention is to provide a device for vibrating a string instrument that can be firmly attached to the string instrument without requiring a drastic or permanent work to be applied thereto for the purpose of using the string instrument as a loudspeaker.

Means to Accomplish the Task

Such objects of the present invention can be accomplished by providing a device (20, 100) for vibrating a string instrument (1) provided with a bridge (13), comprising: a base member (22, 102) provided with a load point member (24, 156) that engages the bridge (13); and a vibration generator (50, 140) mounted on the base member (22, 102) and configured to convert an electric signal into a mechanical vibration; wherein the base member (22, 102) includes a fulcrum member (30, 120) engaging an upper side of at least one string (9) of the string instrument (1), an anchor member (38, 130) engaging a lower side of the at least one string (9) at a point located between the load point member (24, 156) and the fulcrum member (30, 120) and a means (40, 132) for displacing at least one of the fulcrum member (30, 120) and the anchor member (38, 130) in a direction to urge the load point member (24, 156) against the bridge (13).

The vibrating device (20, 100) engages the string (9) at the fulcrum member (30, 120) and the anchor member (38, 130), and engages the bridge (13) at the load point member (24, 156) so that the vulnerable parts such as the soundboard of the string instrument (1) is avoided, and only the high strength part thereof is engaged. Therefore, the load point member (24, 156) can be pressed upon the bridge (13) with an adequate force so that the string instrument can be sounded with a large sound volume and a high sound quality. The term "bridge" means a member that is attached to the soundboard or the like to define an end of a string (9), and may also be called as "saddle". The name of this part may vary depending on each particular kind of musical instruments. In the description and claims of this application, the term "bridge" should be interpreted in the broadest meaning as meaning a member that delimits an effective end of a string.

Preferably, the anchor member (38, 130), the load point member (24, 156) and the fulcrum member (30, 120) are located along a length of the string (9). Typically, the vibration generator (50, 140) and the load point member (24, 156) are located on one end part of the base member (22, 102), and the fulcrum member (30, 120) is provided on the other end part of the base member (22, 102). When the cam mechanism for lifting the anchor member (38, 130) upward is provided on the base member (22, 102), the load point member (24, 156) can be pushed against the bridge (13) by using a simple structure.

The load point member (24, 156) may consist of a single projection or a pair of projections arranged symmetrically about the center. In either case, the vibrating device (20, 100) can be supported on the musical instrument in a manner corresponding to the shape of the bridge (13) of the musical instrument in a stable manner.

The anchor member (38, 130) may comprise a rod member or a hook member engaging at least two strings (9) of the string instrument and extending along a direction perpendicular to an axial line connecting central parts of the load point member (24, 156) and the fulcrum member (30, 120) with each other. The rod member may be supported so as to be moveable toward and away from the musical instrument. The fulcrum member (30, 120) may comprise a rod member engaging at least two strings (9) of the string instrument and extending along a direction perpendicular to an axial line connecting central parts of the load point member (24, 156) and the fulcrum member (30, 120) with each other.

The base member (22) may comprise a locating portion (28) provided adjacent to the load point member (24), the locating portion (28) being configured to abut the bridge (13) from a side of the fulcrum member (30) in a lengthwise direction of the strings (9). Thereby, simply by sliding the vibrating device (20) along the strings (9), the axial positioning of the vibrating device (20) can be accomplished in a both simple and precise manner.

In order for a wide frequency range of sound to be reproduced, the vibration generator may comprise a pair of vibration generators (50A, 50B), one for high frequency range sound and the other for low frequency range sound, provided on either side of an axial line extending between centers of the load point member (24) and the fulcrum member (30).

Preferably, the base member (22) includes a pair of bifurcated parts (22A, 22B) that support the high frequency range vibration generator (50A) and the low frequency vibration generator (50B), respectively, and the load point member (24) is provided on each of the bifurcated parts (22A, 22B).

Preferably, a first vibration insulation member (108) for insulating vibrations between a vibration transmission member (152) of the vibration generator (140) and the base member (102) is provided between the vibration transmission member (152) and the base member (102).

Thereby, the vibration transmission member (152) is mounted on the base member (102) via the first vibration insulation member (108) so that the mechanical vibration of the vibration transmission member (152) is prevented from being transmitted to the base member (102). Thereby, the mechanical vibration of the vibration transmission member (152) is prevented from being transmitted to the fulcrum member (120) and the anchor member (130) via the base member (102) so that the mechanical vibration of the vibration transmission member (152) is prevented from being transmitted to the strings (9), and the sound is emitted strictly from the body (5). Therefore, the produced sound has a high quality, and in particular has a high clarity owing to the absence of noises in high frequency ranges.

Preferably, a second vibration insulation member (116) for insulating vibrations between the base member (102) and the fulcrum member (120) is provided between the base member (102) and the fulcrum member (120), and a third vibration insulation member (126) for insulating vibrations between the base member (102) and the anchor member (130) is provided between the base member (102) and the anchor member (130).

In this case, the mechanical vibration of the vibration transmission member (152) is prevented from being transmitted to the fulcrum member (120) and the anchor member (130) via the base member (102) so that an even higher quality sound can be achieved by the emission of sound from the body (5).

Effect of the Invention

Thus, the present invention provides a vibrating device for a string instrument that allows the string instrument to be sounded with a large sound volume and a high sound quality without requiring a drastic or permanent work to be applied thereto, and allows the string instrument to be favorably utilized as a loudspeaker.

DETAILED DESCRIPTION OF THE PREFERRED EMBODIMENT(S)

Preferred embodiments of the present invention are described in the following with reference to the appended drawings. In the following description, the axial direction of the string instrument is defined as a line extending between a soundboard side and a head side of the string instrument. In regard to the soundboard located on the front side of the instrument, the direction directed toward the soundboard from the front side thereof is referred to as a downward direction or a backside direction, and the direction directed away from the soundboard is referred to as an upward direction or a front side direction. The term "bridge" as used in this description refers to a member attached to the soundboard or the like to define the corresponding effective end of the string, and may also be called by other names such as "saddle" depending on the kinds of the string instruments. In the description and claims of this application, the term "bridge" should be interpreted in the broadest meaning as a member that delimits an effective end of a string.

Figure 1:
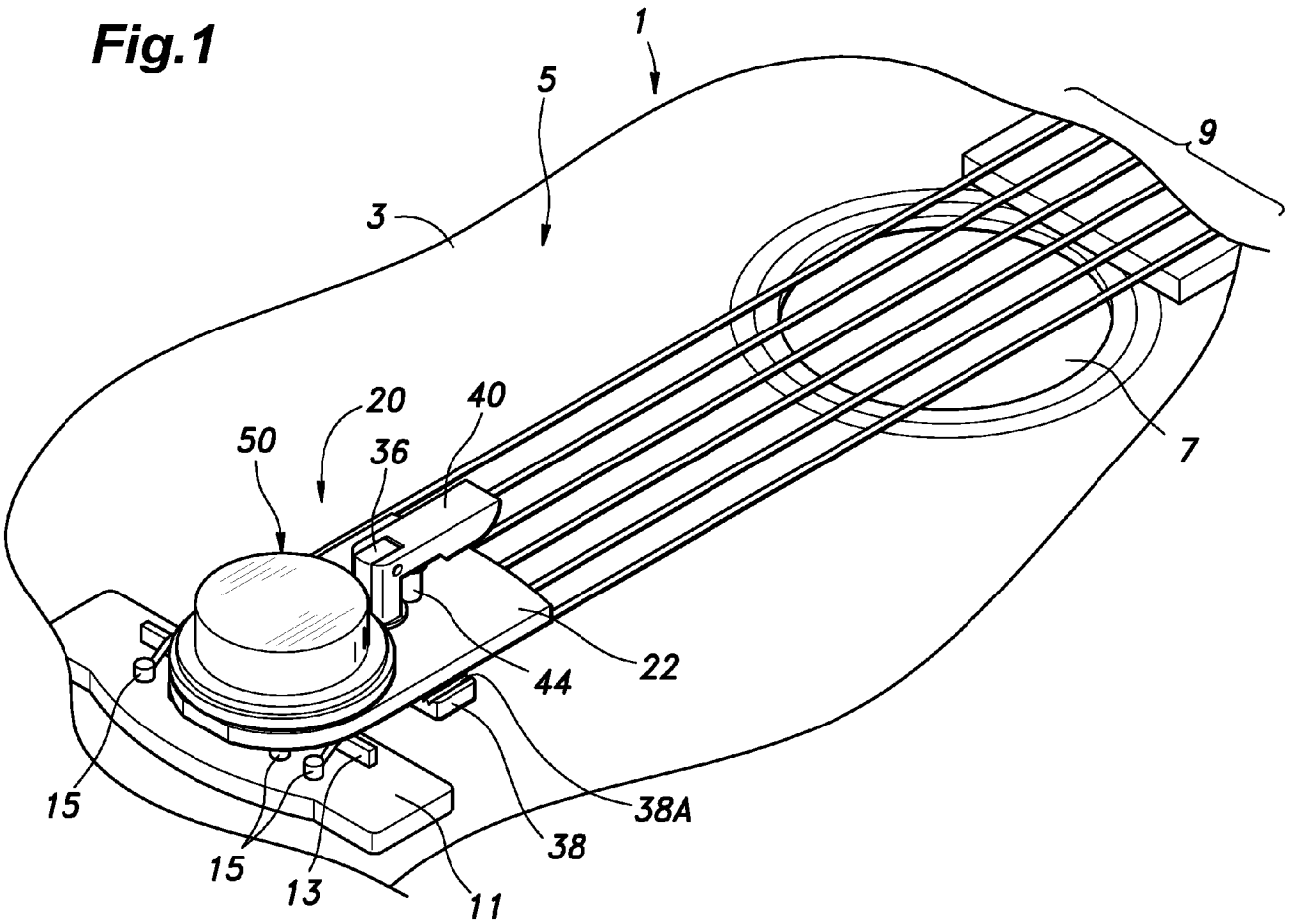
FIG. 1 is a perspective view of a vibrating device for a string instrument given as a first embodiment of the present invention applied to a guitar.
Figure 2:
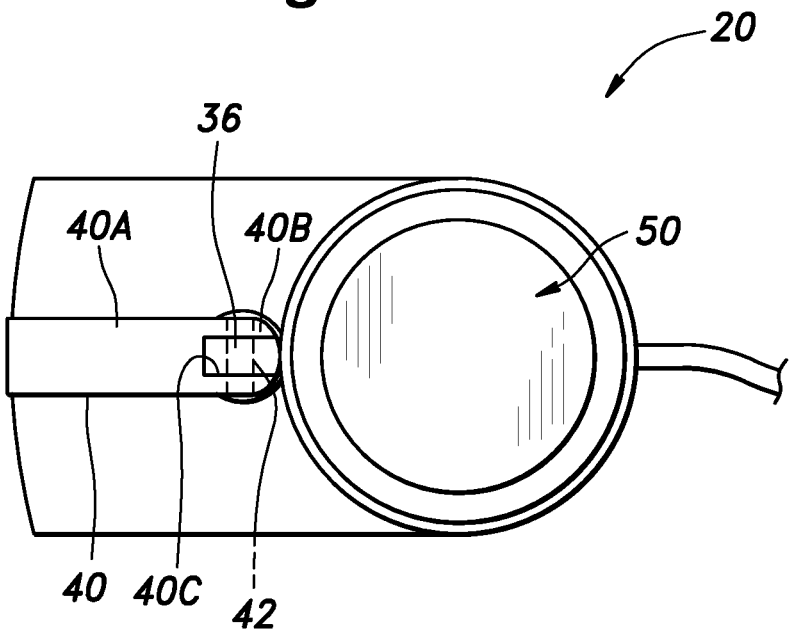
FIG. 2 is a front view of the first embodiment.
Figure 3:
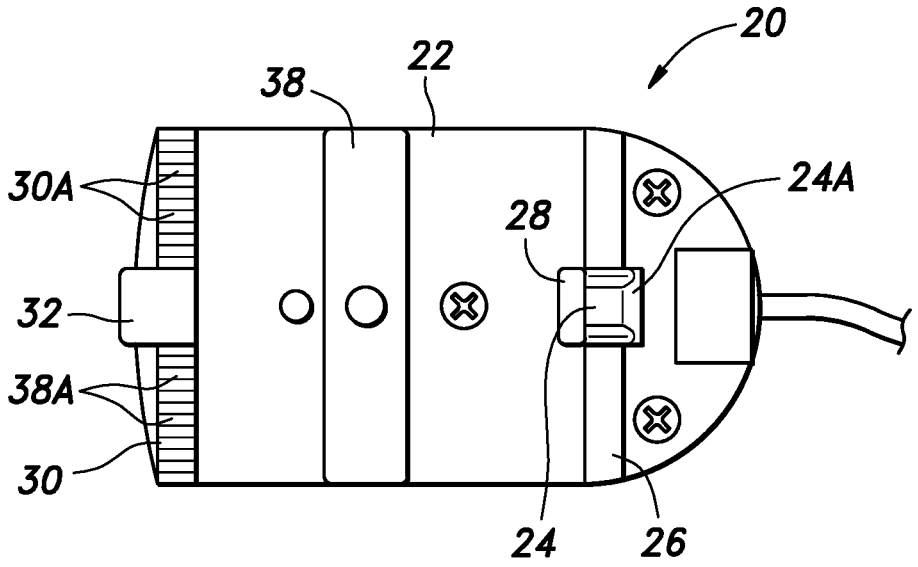
FIG. 3 is a rear view of the first embodiment.

As shown in FIG. 1, a guitar 1 having a vibrating device 20 attached thereto is provided with a body 5 formed by a front board (soundboard) 3, a sideboard (not shown in the drawing) and a back board (not shown in the drawing). The front board 3 is formed with a sound hole 7. The guitar 1 has six strings 9.

A bridge base member 11 consisting of a strip of plate is fixedly attached to the front board 3 by using an adhesive agent. A bridge (saddle) 13 extending perpendicularly to the lengthwise direction of the strings 9 is attached to the bridge base member 11.

An end of each string 9 is passed above the bridge 13 and is secured to a bridge pin 15 which is in turn fixedly secured to the bridge base member 11. The string 9 is placed under tension by a tension adjusting mechanism (not shown in the drawing) which is connected to the other end of the string 9 so that the string 9 is pressed against the upper side of the bridge 13 and the bridge 13 defines an effective end of the string 9.

A vibrating device 20 given as a first embodiment of the present invention is described in the following with reference to FIGS. 2 to 5. The vibrating device 20 includes a base member 22 consisting of a substantially rectangular plate member elongated in the lengthwise direction of the strings 9.

The lower surface of the base member 22 facing the guitar 1 is fitted with or formed with a vibration transmission member 26 in a lengthwise end part of the base member 22, and the vibration transmission member 26 is centrally provided with a load point member 24 in the form of a projection. The vibration transmission member 26 is further provided with a locating projection 28 in a part thereof slightly offset from the load point member 24 toward the other end with respect to the lengthwise direction. The locating projection 28 projects slightly further than the load point member 24. The side of the load point member 24 facing away from the locating projection 28 is formed with a guide slope 24A that facilitates the mounting of this device as will be described hereinafter.

The other lengthwise end of the base member 22 is fitted with or formed with a fulcrum member 30 consisting of a rod shaped member extending perpendicularly to the lengthwise direction of the strings 9 on the lower surface thereof facing the guitar 1. The lower surface of the fulcrum member 30 is formed with a large number of grooves 30A extending in the lengthwise direction of the base member 22. These grooves 30A prevent slippage between the strings 9 and the fulcrum member 30 when the device is in operation. A laterally central part of the fulcrum member 30 is provided with a projection 32 which serves as a guide member when sliding the vibrating device 20 over the strings 9 in the lengthwise direction into an operating position by being fitted between the two central strings 9.

A lengthwise middle part of the base member 22 is centrally provided with a support hole 34 passed (vertically) through the thickness of the base member 22. The support hole 34 receives a support member 36 in a both rotatable and vertically slidable manner, and a lower end of the support member 36 projecting below the base member 22 is fitted with an anchor member 38. The anchor member 38 consists of a rod member extending perpendicularly to the lengthwise direction of the strings 9 between the vibration transmission member 26 (load point member 24) and the fulcrum member 30. The upper surface of the anchor member 38 is formed with a large number of grooves 38A (FIG. 1) extending in the lengthwise direction of the base member 22 in a similar manner as the lower surface of the fulcrum member 30.

A lever cam 40 is provided on the base member 22. The lever cam 40 consists of an L-shaped member including an arm 40A and a cam 40B extending perpendicularly from each other and having a pivot pin 42 passed through the junction of these two parts as will be discussed hereinafter. A slot 40C extends from the free end of the cam 40B to the junction between the two parts. The slot 40C receives the upper end of the support member 36, and the pivot pin 42 is passed through the junction of the lever cam 40 and through the upper end of the support member 36 across the slot 40C so that the lever cam 40 is pivotally connected to the support member 36 via the pivot pin 42.

A mushroom pin 44 projects upward from the upper surface of the base member 22 at a part thereof adjoining the support member 36 from the side of the fulcrum member 30. The pivotal movement of the lever cam 40 around the pivot pin 42 is permitted by the mushroom pin 44 being received by the slot 40C, and the range of the pivotal movement of the lever cam 40 is delimited by the arm 40A or the cam 40B of the lever cam 40 being engaged by an enlarged head 44A of the mushroom pin 44.

Figure 4:
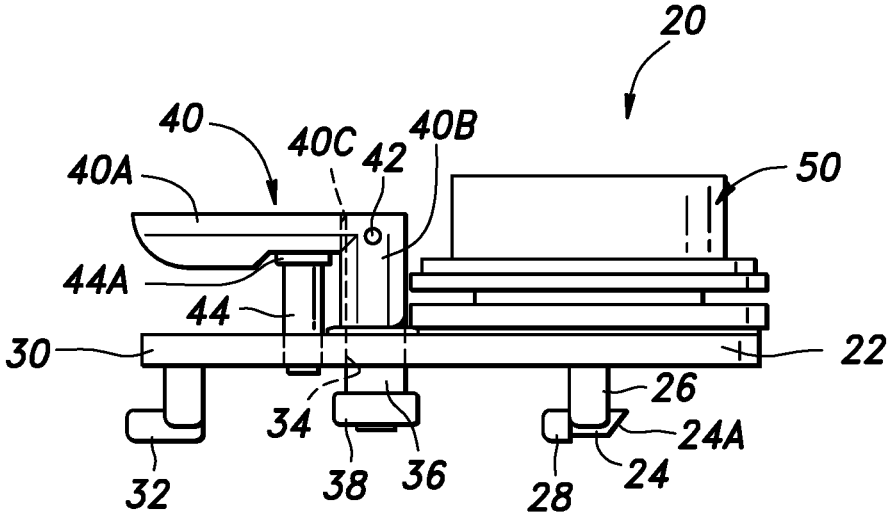
FIG. 4 is a side view of the first embodiment.
Figure 5:
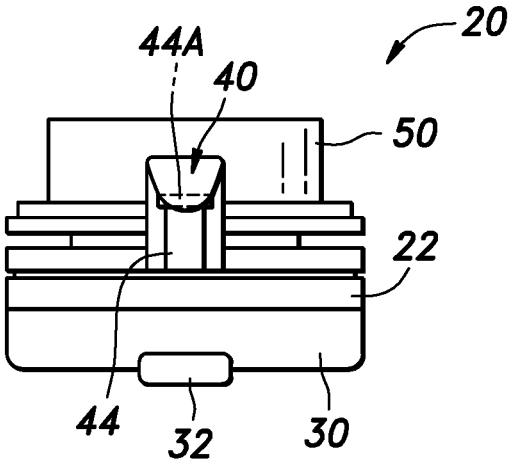
FIG. 5 is an end view of the first embodiment.
Figure 8A:
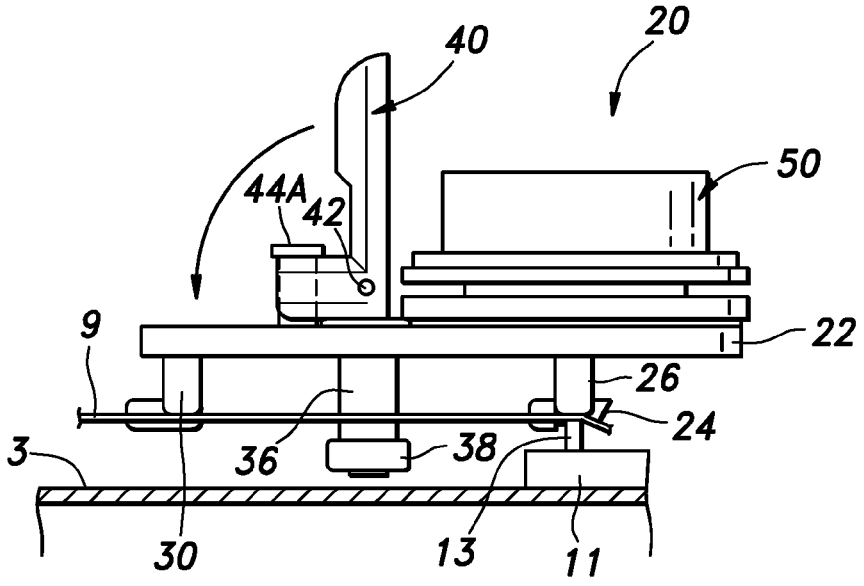
FIG. 8 is a view similar to FIG. 4 showing a mode of operation of the first embodiment.

In this support structure, when the arm 40A of the lever cam 40 is placed in the horizontal posture illustrated in FIG. 4, the cam 40B is in the upright position so that the anchor member 38 is placed in a raised position. When the arm 40A of the lever cam 40 is pivoted into the upright posture as shown in FIG. 8A, the cam 40B is laid flat on the base member 22 so that the anchor member 38 is placed in a lowered position.

The free end of the cam 40B is formed as a flat end in the illustrated embodiment, but may also be formed in different configurations as long as the cam 40B is enabled to perform the function thereof.

Figure 6:
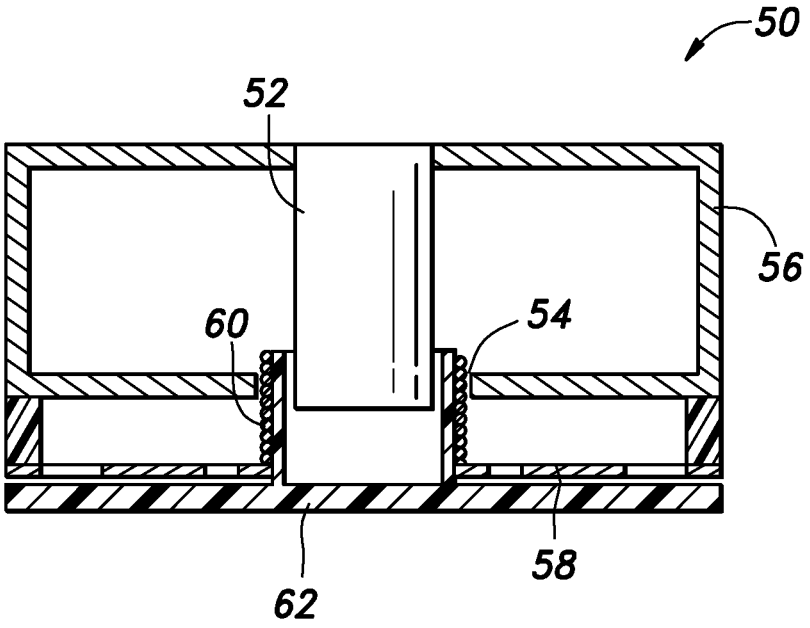
FIG. 6 is a vertical sectional view of a vibration generator for the first embodiment.

A vibration generator 50 is mounted on a front surface of the base member 22 facing away from the guitar 1 at a lengthwise end portion thereof. As shown in FIG. 6, the vibration generator 50 includes a solid cylindrical permanent magnet 52, a yoke member 56 extending from a part thereof connected to an axial end of the permanent magnet 52 to a part thereof surrounding the outer circumferential surface of the other axial end of the permanent magnet 52 at a prescribed magnetic gap 54 and a voice coil 60 resiliently supported by a spring member 58 so as to be positioned in the magnetic gap 54. A disk 62 made of plastic material is fixed to the voice coil 60 as an output end. The yoke member 56 is surrounded by an appropriate case which is not shown in the drawing.

Figure 7:
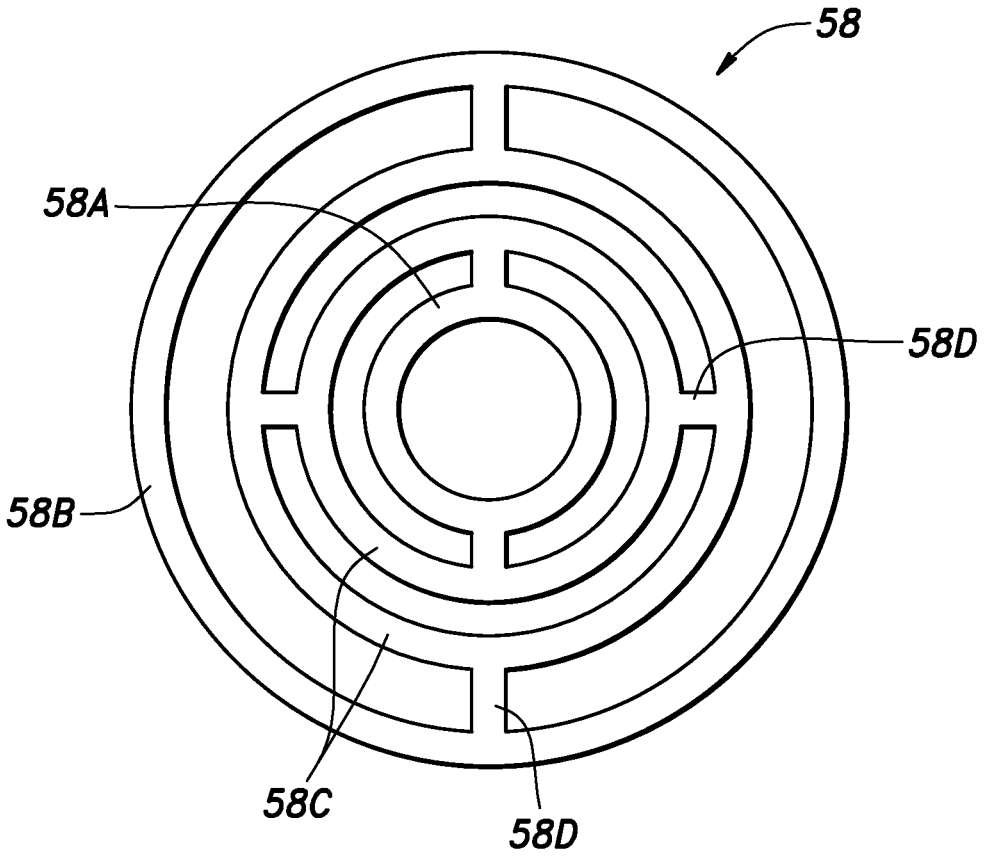
FIG. 7 is a front view of the spring member used in the vibration generator shown in FIG. 6.

As shown in FIG. 7, the spring member 68 is made by cutting a sheet spring into a prescribed shape, and integrally includes an inner annular portion 58A fixedly attached to the disk 62 in the center, an outer annular portion 58B disposed coaxially with respect to the inner annular portion 58A, a pair of concentric intermediate annular portions 58C and a plurality of bridge portions 58D connecting adjoining annular portions 55A, 55B and 55C at an angular interval of 90 degrees.

When the vibration generator 50 receives a supply of electric current corresponding a sound signal, the voice coil 60 causes a vibratory movement of the disk 62. Therefore, any object that is directly or indirectly attached to the disk 62 which in this case consists of the vibration transmission member 26 is caused to vibrate.

The mode of operation of the vibrating device 20 is described in the following with reference to FIG. 8.

First of all, as shown in FIG. 8A, the arm 40A of the lever cam 40 is lifted until the support member 36 is caused to project downward from the base member 22 to the maximum extent. By suitably turning the base member 22 so as to be perpendicular to the strings 9, the rod-shaped anchor member 38 can be passed through the gap between the adjoining strings 9 in the center and positioned below the strings 9. The vibration transmission member 26 is then slid along the upper side of the strings 9 toward the bridge 13 until the locating projection 28 abuts the bridge 13. During this process, the vibration transmission member 26 is favorably guided by the strings 9 so that the load point member 24 of the vibration transmission member 26 can favorably ride onto the bridge 13 owing to the sliding movement of the guide slope 24A over the bridge 13 as the load point member 24 is forced against the bridge 13. The relative position between the locating projection 28 and the load point member 24 is determined such that the load point member 24 is correctly engaged by the upper surface of the bridge 13 as a result of this process.

Figure 8B:
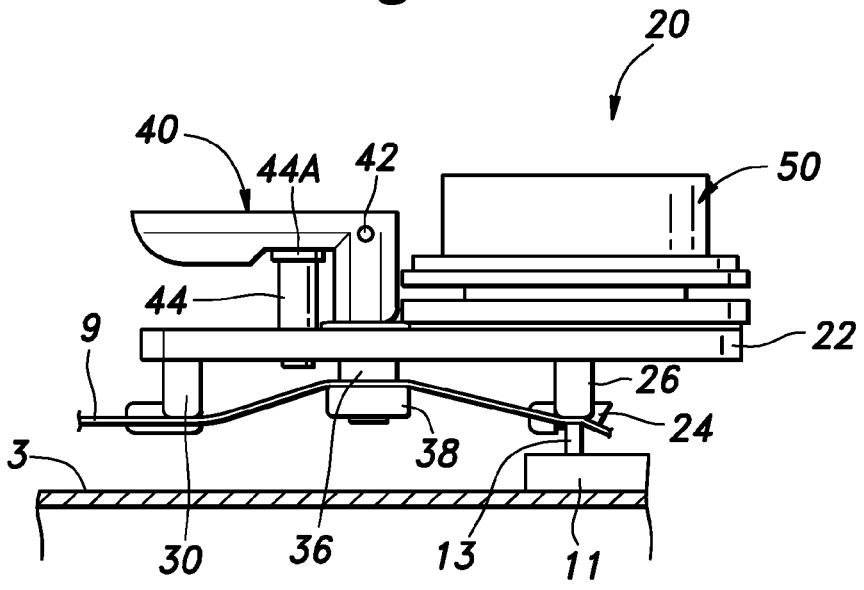

When the arm 40A of the lever cam 40 is pushed down under this condition as shown in FIG. 8B, owing to the camming action between the cam 40B of the lever cam 40 and the corresponding part of the base member 22, the anchor member 38 along with the support member 36 is raised. This upward motion of the anchor member 38 causes the anchor member 38 to be pushed against the lower side of the strings 9. As a result, the base member 22 creates a third class lever including the fulcrum formed by the contact between the fulcrum member 30 and the strings 9, the effort point formed by the contact between the anchor member 38 and the strings 9, and the load point formed by the contact between the load point member 24 such that the load point member 24 of the vibration transmission member 26 is pushed against the upper surface of the bridge 13. In particular, when the anchor member 38 is pushed firmly against the lower side of the strings 9 against the elastic force produced by the strings 9, the load point member 24 of the vibration transmission member 26 is pressed against the bridge in a correspondingly firm manner with the fulcrum member 30 acting as the fulcrum.

The magnitude of this pressing force can be freely selected by appropriately determining the dimensions and the configurations of the lever cam 40. The magnitude of the pressing force can also be adjusted by changing the tension of the strings 9 on which the vibrating device 20 is mounted. The grooves 30A and 38A formed in the fulcrum member 30 and the anchor member 38 perform the function of preventing the strings 9 from slipping sideways, and contribute to supporting the vibrating device 20 on the string instrument in a stable manner. Alternatively or additionally to the grooves 30A and 38A formed in the fulcrum member 30 and the anchor member 38, a rubber layer may be provided on the surface of the fulcrum member 30 and/or the anchor member 38 so that the frictional force between these members and the strings 9 may be increased.

The anchor member 38 is supported by a plurality of strings 9 while the single load point member 24 provided centrally in the vibration transmission member 26 is supported by the bridge 13 so that the vibrating device 20 is supported at three points including the fulcrum provided by the fulcrum member 30. Therefore, the vibrating device 20 can be mounted on the guitar 1 firmly against vibrations without modifying the guitar 1 for mounting the vibrating device 20. Because the vibrating device 20 engages the strings 9 at the fulcrum member 30 and the anchor member 38 and the bridge 13 at the load point member 24, the vibrating device 20 is required to engage only the relatively strong parts of the guitar 1, and the vulnerable parts of the guitar 1 such as the front board 3 of the guitar 1 are spared from loading.

When the vibration generator 50 is activated under this condition, the produced vibrating force is transmitted to the front board 3 via the bridge 13, and the vibration energy produced from the vibration generator 50 can be converted into acoustic energy at a high efficiency via the vibration of the front board 3 and the resulting vibration of the air in the body 5.

The signal that is to be applied to the vibrating device 20 may be derived from various sound sources such as compact disks, radio broadcasts and live music captured by microphones. It is also possible to attach a vibration pickup device on a part of a string instrument itself such as the body and the bridge, and use the output from the pickup device as a sound source. Thereby, the sound produced by the string instrument can be reproduced in a highly favorable manner. If the vibrating device 20 is mounted on a plurality of string instruments of either a same kind or different kinds, a particularly impressive sound quality can be achieved.

According to the experiments conducted by the inventors, when the device of the present invention is attached to a guitar, not only guitar musical pieces but also musical pieces of other musical instruments having a similar sound quality and sound range could be favorably reproduced. It was also demonstrated that the device of the present invention attached to a relatively small musical instrument can produce sound of a wider frequency range and a greater volume than a loudspeaker provided with a loudspeaker box of a comparable size.

Figure 9:
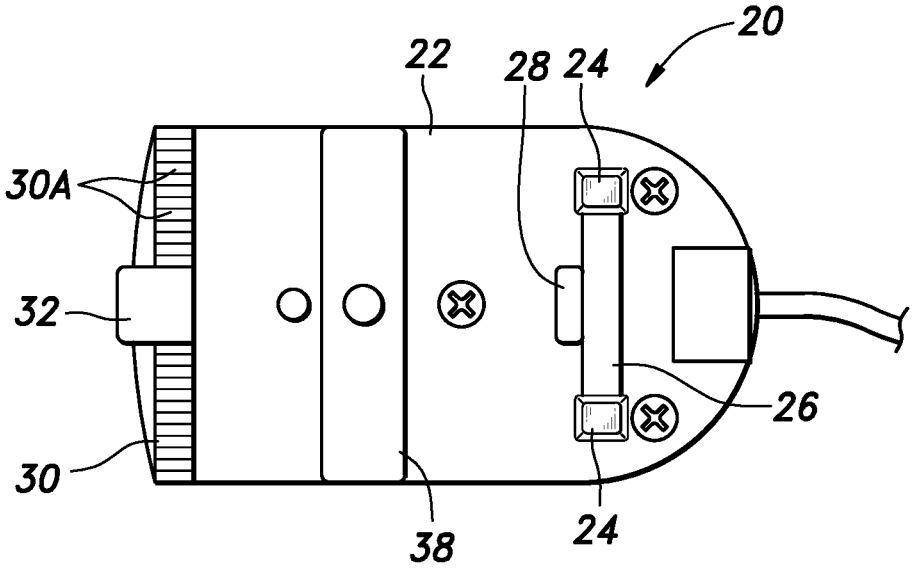
FIG. 9 is a view similar to FIG. 4 showing a vibrating device for a string instrument given as a second embodiment of the present invention.

FIG. 9 shows a second embodiment of the present invention. In FIG. 9, the parts corresponding to those of the previous embodiment are denoted with like numerals without necessarily repeating the description of such parts.

In this embodiment, the vibration transmission member 26 is provided with a pair of projections serving as the load point members 24 that are to be engaged by the bridge 13. In this case, the two load point members 24 provided on the vibration transmission member 26 are supported by the bridge 13. In this case, the vibrating device 20 can be supported by the guitar 1 in a stable manner even when the anchor member 38 is supported by only one string 9 in the center.

Figure 10:
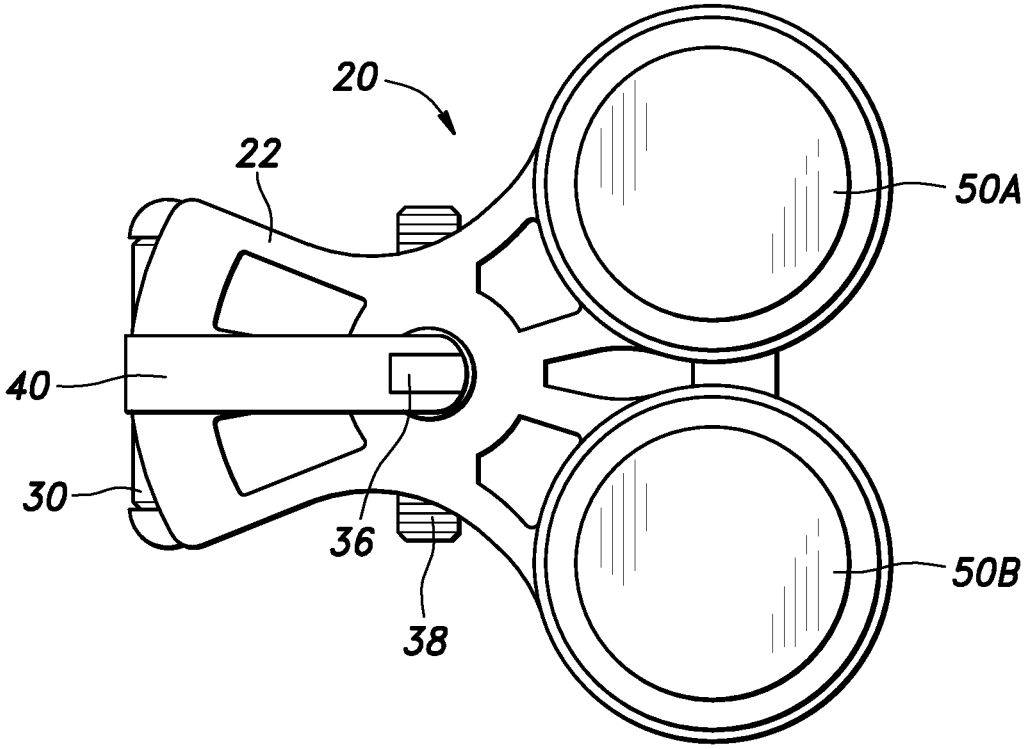
FIG. 10 is a front view showing a vibrating device for a string instrument given as a third embodiment of the present invention.
Figure 11:
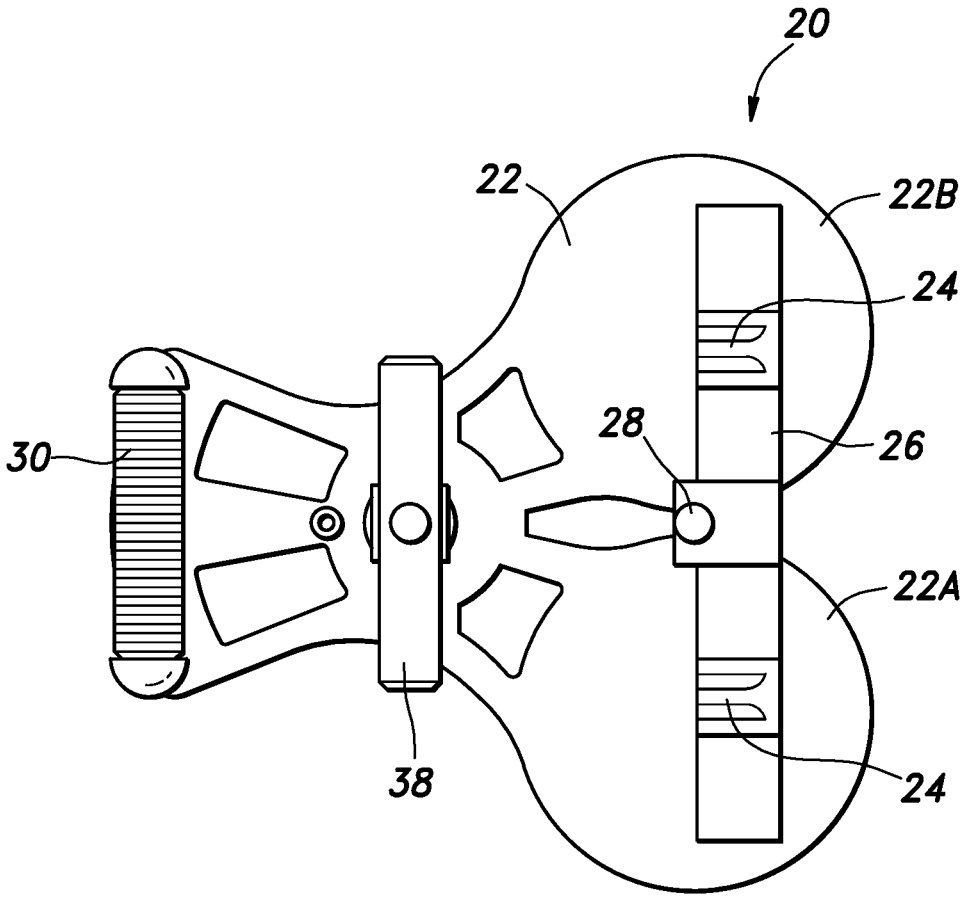
FIG. 11 is a rear view of the third embodiment.

FIGS. 10 and 11 illustrate the third embodiment of the present invention. In FIGS. 10 and 11, the parts corresponding to those of the previous embodiments are denoted with like numerals without necessarily repeating the description of such parts.

In this embodiment, one of the lengthwise ends of the base member 22 is bifurcated into two bifurcated parts 22A and 22B. A vibration generator 50A, 50B is attached to each bifurcated part 22A, 22B. One of the vibration generators 50A is for producing sound in a high frequency range, and the other vibration generator 50B is for producing sound in a low frequency range. Each vibration generator 50A, 50B may be constructed similarly as the one shown in FIGS. 6 and 7, and the spring member 58 of the vibration generator 50A for the high frequency range is provided with a higher stiffness than that of the vibration generator 50B for the low frequency range.

The backside of the base member 22 is provided with a vibration transmission member 26 extending laterally at the position corresponding to the vibration generators 50A and 50B, and a pair of projections project from parts of the vibration transmission member 26 corresponding to the central positions of the vibration generators 50A and 50B, respectively, as the load point members 24 that are to be engaged by the bridge 13. The central part of the vibration transmission member 26 is made of highly deformable member such as rubber so that the two bifurcated parts 22A and 22B are allowed to vibrate with relatively little resistance and independently from each other toward and away from the string instrument.

According to this illustrated embodiment the string instrument can be vibrated over a wide sound frequency range so that musical pieces covering a wide sound range such as orchestra music pieces can be reproduced in a favorable manner.

In this embodiment, the vibration transmission member 26 extends over the two bifurcated parts 22A and 22B of the base member 22, but two such vibration transmission members 26 each provided with a separate load point member 24 may also be provided individually on the two bifurcated parts 22A and 22B, respectively. The locating projection 28 may be provided on each vibration transmission member 26, or on only one of the two vibration transmission members 26. Alternatively, the locating projection 28 may be provided on positions other than the vibration transmission member 26 such as the base member 22.

Figure 12:
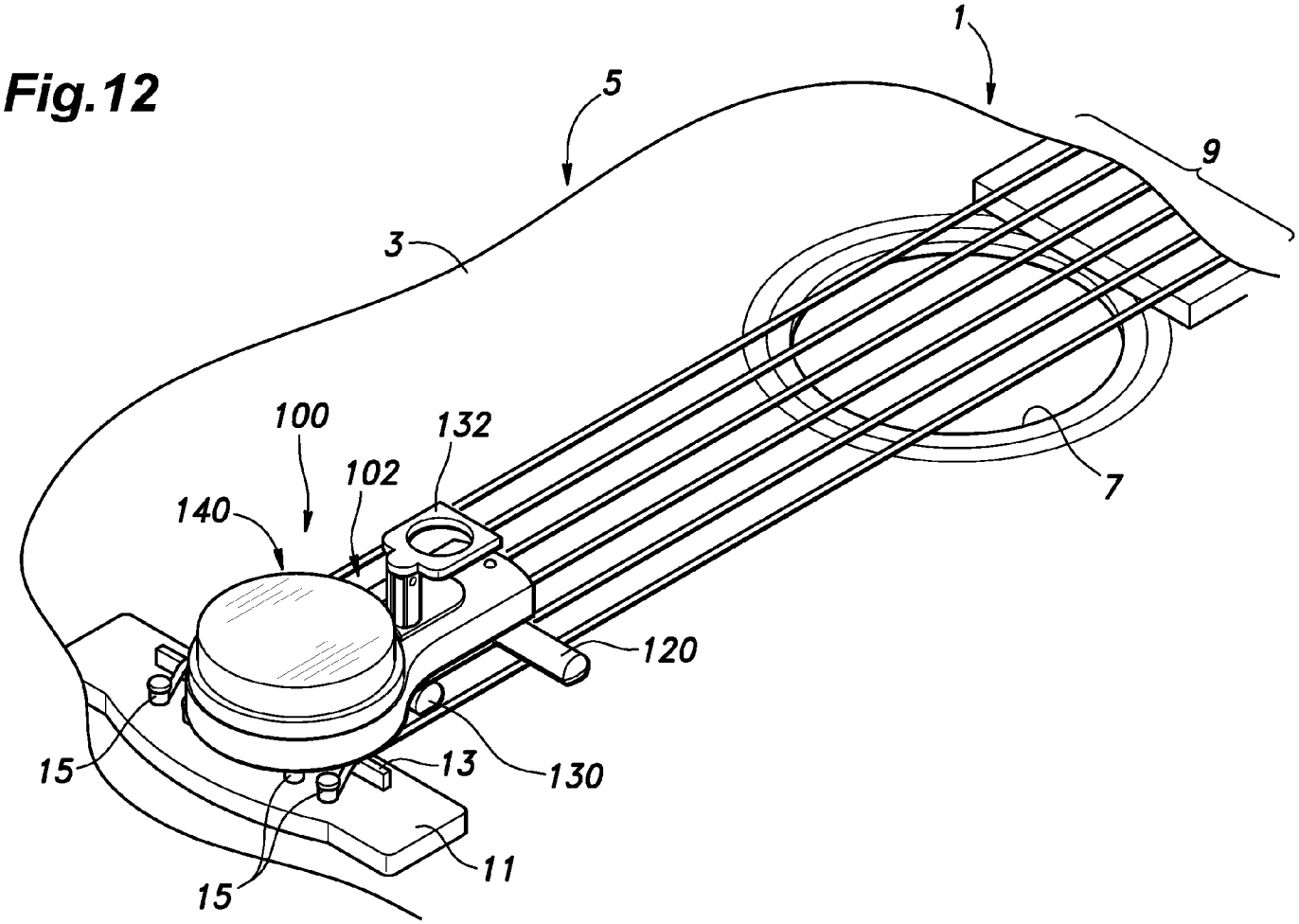
FIG. 12 is a perspective view of a vibrating device for a string instrument given as a fourth embodiment of the present invention applied to a guitar.
Figure 13:
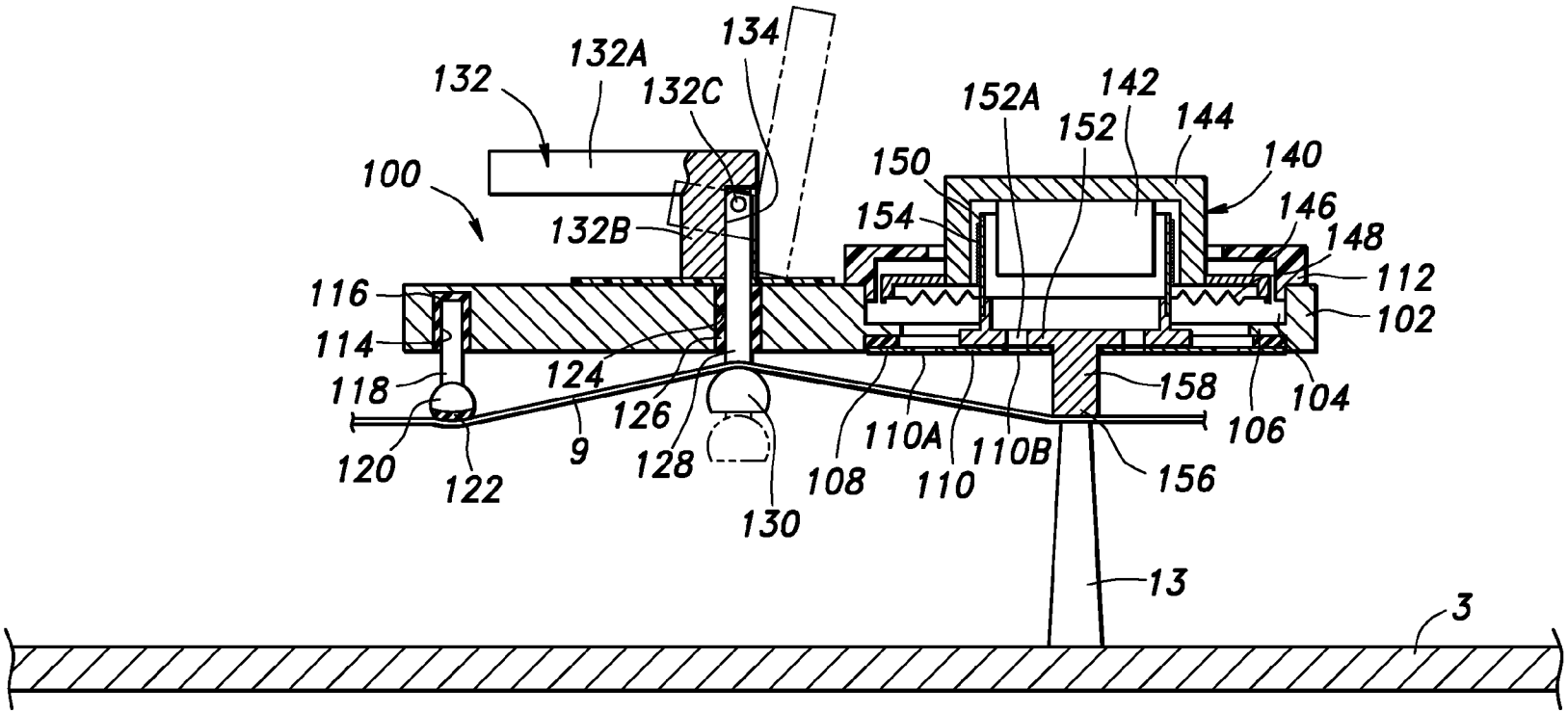
FIG. 13 is a vertical sectional view of the fourth embodiment of the present invention.

FIGS. 12 and 13 illustrate the fourth embodiment of the present invention. In FIGS. 12 and 13, the parts corresponding to those of the previous embodiments are denoted with like numerals without necessarily repeating the description of such parts.

As shown in FIG. 13, the vibrating device 100 includes a base member 102 made of aluminum and elongated in the lengthwise direction of the strings 9. A circular opening 104 is passed through a lengthwise end part of the base member 102.

A vibration generator 140 is placed in the opening 104. The vibration generator 140 includes a solid cylindrical permanent magnet 142, a hollow cylindrical yoke member 144 with a closed upper end and made of magnetic material which is magnetically connected to the upper end (one of the magnetic poles) of the permanent magnet 142, a hollow cylindrical bobbin 150 made of non-magnetic material and connected to the yoke member 144 in a vertically moveable manner via a support member 146 and a spring member 148, a disk shaped vibration transmission member 152 attached to the bobbin 150 and a voice coil (moving coil) 154 wound around the bobbin 150.

The vibration transmission member 152 is centrally provided with a projection 158 projecting downwardly from the vibration transmission member 152 so that the center of the projection 158 serves as a load point member 156. The spring member 148 may be similar to the spring member 58 of the first embodiment.

The base member 102 is provided with a radial flange 106 extending radially inward from a vertically (axially) middle point of the inner circumferential of the opening 104. A vibration insulation sheet (first vibration insulation member) 108 is attached to the lower surface of the flange 106 by using an adhesive agent. The vibration transmission member 152 is supported by the base member 102 via a support plate 110 having an outer peripheral part attached to the vibration insulation sheet 108 by using an adhesive agent and a central part attached to the flat bottom surface of the vibration transmission member 152 by using an adhesive agent. In other words, the base member 102 supports the vibration transmission member 152 via the support plate 110 and the vibration insulation sheet 108.

The vibration insulation sheet 108 is made of cushioning material such as foamed plastic and ether polyurethane, and minimizes the transmission of mechanical vibrations from the vibration transmission member 152 to the base member 102 by undergoing an elastic deformation.

The support plate 110 may be made of metallic or plastic material and is provided with slits 110A or slots so as to demonstrate a spring property. Therefore, the vibration generator 140 is resiliently supported by the base member 102.

When an electric signal (electric current) is supplied to the voice coil 154 of the vibration generator 140, owing to the magnetic interaction of the coil 154 with the permanent magnet 142 and the yoke member 144, the vibration transmission member 152 is vertically displaced or mechanically vibrates with respect to the side of the yoke member 144 against the spring force of the spring member 148.

The support plate 110 and the vibration transmission member 152 are provided with air openings 110B and 152A, respectively, for communicating the inner space of the bobbin 150 with the exterior so that a fluid resistance due to the compression of air in the bobbin 150 may be avoided during the vibratory movement of the bobbin 150. The slits 110A in the support plate 110 may function as holes for communicating the interior of the opening 104 with the exterior.

The upper peripheral part of the opening 104 is provided with a protective ring member 112 for closing the upper end of the opening 104 without interfering with the yoke member 144.

The other lengthwise end part of the base member 102 is centrally provided with a support hole 114 having an open lower end. The support hole 114 receives a support rod 118 therein via a vibration insulation sleeve (second sound vibration insulation member) 116. The lower end of the support rod 118 projects downward from the base member 102, and the projecting lower end of the support rod 118 is fitted with a fulcrum member 120 consisting of a rod member extending perpendicularly to the lengthwise direction of the strings 9.

The vibration insulation sleeve 116 is made of cushioning material such as ether polyurethane having a rubber resiliency. A rubber sheet 122 is bonded to the lower surface of the fulcrum member 120 by using an adhesive agent. The rubber sheet 122 prevents the slippage between the fulcrum member 120 and the strings 9 during use, and insulates vibrations between the fulcrum member 120 and the strings 9 at the same time.

A lengthwise middle part of the base member 102 is centrally provided with a support hole 124 passed through the thickness of the base member 102. A support shaft 128 is received in the support hole 124 via a vibration insulation sleeve (third vibration insulation member) 126 in a rotatable and vertically slidable manner. The lower end of the support shaft 128 extends downward from the base member 102, and the projecting lower end of the support shaft 128 is fitted with an anchor member 130. The anchor member 130 consists of a rod member extending perpendicularly to the lengthwise direction of the strings 9 between the vibration transmission member 152 (load point member 156) and the fulcrum member 120.

The vibration insulation sleeve 126 is made of cushioning material such as ether polyurethane having a rubber resiliency.

A lever cam 132 is provided on the base member 102. The lever cam 132 consists of an L-shaped member including an arm 132A and a cam 132B extending perpendicularly from each other and having a pivot pin 134 passed through the junction of these two parts. A slot 132C is formed in the cam 132B. The slot 132C receives the upper end of the support shaft 128, and the pivot pin 134 is passed through the junction of the lever cam 132 and through the upper end of the support shaft 128 across the slot 132C so that the lever cam 132 is pivotally connected to the support shaft 128 via the pivot pin 134.

In this support structure, when the arm 132A of the lever cam 132 is placed in the horizontal posture illustrated in FIG. 12 by solid lines, the cam 132B is in the upright position so that the anchor member 130 is placed in a raised position. When the arm 132A of the lever cam 132 is pivoted into the upright posture as shown in FIG. 12 by imaginary lines, the cam 132B is laid horizontally on the base member 102 so that the anchor member 130 is placed in a lowered position.

The mode of operation of the vibrating device 100 is described in the following.

The cam 132B of the lever cam 132 is laid horizontally by lifting the arm 132A as shown by the imaginary lines in FIG. 12 so that the anchor member 130 is placed in the lowered position. By suitably turning the anchor member 130 so as to be perpendicular to the strings 9, the rod-shaped anchor member 130 is passed through the gap between the adjoining strings 9 in the center and positioned below the strings 9. The anchor member 130 is then put back to the original position perpendicular to the lengthwise direction of the strings 9, and the load point member 156 is placed on the strings 9 on the bridge 13 or on the bridge 13 itself while the rubber sheet 122 of the fulcrum member 120 is placed on the strings 9.

The lever cam 132 is then tilted down as shown by the solid lines in FIG. 12 so that the arm 132A is placed into the upright posture to raise the support shaft 128. As a result, the anchor member 130 is placed in the raised position so that the strings 9 are pushed upward by the anchor member 130 at the part of the strings 9 located between the parts of the strings 9 engaging the load point member 156 and the fulcrum member 120.

The lifting of the strings 9 in this manner causes the base member 102 to act as a third class lever which has the fulcrum at the engagement point between the fulcrum member 120 and the strings 9, the effort point at the engagement point between the anchor member 130 and the strings 9 and the load point at the engagement point between the load point member 156 and the strings 9. Thus, by pressing the fulcrum member 120 against the upper side of the strings 9, and the anchor member 130 against the lower side of the strings 9, with the vibrating device 100 supported by the strings 9, the free end of the projection 158 of the vibration transmission member 152 or the load point member 156 is pushed against the bridge 13. As a result, without requiring to modify the guitar 1 for mounting the vibrating device 100 thereon, the vibrating device 100 can be mounted on the guitar 1 in a highly firm manner against vibrations.

Thus, the vibrating device 100 engages the strings 9 at the fulcrum member 120 and the anchor member 130, and engages the bridge 13 at the load point member 156 so that the vulnerable parts of the guitar 1 such as the soundboard are left untouched, and only the parts having a high mechanical strength are engaged by the vibrating device 100. Furthermore, this vibrating device 100 allows the load point member 156 to be adequately firmly pressed against the bridge 13.

When an electric signal is supplied to the voice coil 154 of the vibration generator 140 to cause the vibration transmission member 152 to undergo a mechanical vibration, this mechanical vibration is transmitted from the vibration transmission member 152 to the bridge 13 via the projection 158 so that the soundboard such as the front board 3 vibrates, and the body 5 functions as a loudspeaker box. Because the vibrating device 100 is mounted on the guitar 1 with a high resistance against vibrations, impairment of sound quality that could be caused by the rattling of the vibrating device 100 on the guitar 1 can be avoided, and the possibility of the detachment of the vibrating device 100 from the guitar 1 during use can be eliminated, Furthermore, because the load point member 156 is so firmly attached to the bridge 13 that the mechanical vibration from the vibration transmission member 152 can be efficiently transmitted to the bridge 13, and the guitar 1 can be sounded with a large sound volume and a high sound quality.

Because the vibration transmission member 152 is attached to the base member 102 via the vibration insulation sheet 105 that insulates vibrations, the mechanical vibration of the vibration transmission member 152 is prevented from being transmitted to the base member 102. Therefore, the mechanical vibration of the vibration transmission member 152 that could be otherwise transmitted to the fulcrum member 120 or the anchor member 130 via the base member 102 is prevented from vibrating the strings 9 via the base member 102.

Thereby, the sounding of the body 5 or the acoustic emission from the body 5 due to the vibration of the strings 9 can be avoided, and is caused solely by the vibration of the body 5 which is in turn caused by the vibration of the bridge 13 by the vibrating device 100. Therefore, the sound is emitted from the body 5 so that the produced sound is high in quality, and is free from noises in high frequency ranges.

Even if the mechanical vibration of the vibration transmission member 152 were transmitted to the base member 102, because the vibration insulation sleeves 116 and 126 are interposed between the fulcrum member 120 and the base member 102 and between the anchor member 130 and the base member 102, respectively, the mechanical vibration of the base member 102 would not be transmitted to the fulcrum member 120 or the anchor member 130. For this reason also, the mechanical vibration of the vibration transmission member 152 is prevented from being transmitted to the fulcrum member 120 or the anchor member 130 so that the fulcrum member 120 or the anchor member 130 are prevented from vibrating the strings 9. Therefore, the vibrating device 100 causes the sound to be emitted exclusively from the body 5 so that a high sound quality can be achieved.

According to the embodiments discussed above, sound can be emitted from the guitar having an attractive appearance so that the listener can enjoy a pleasing visual and audio ambiance.

The present invention has been described in terms of specific embodiments, but as can be appreciated by a person skilled in the art, the present invention is not limited by such embodiments, and can be modified without departing from the spirit of the present invention.

For instance, in the foregoing embodiments, a cam mechanism was used to urge the load point member 24 of the vibration transmission member 26 against the bridge 13 by pushing the anchor member 38 onto the lower side of the strings 9. However, it is also possible to fixedly secure the anchor member 38 to the base member 22, and use a cam mechanism to urge the load point member against the bridge by pushing the fulcrum member 30 onto the lower side of the strings 9.

In the illustrated embodiments, the vibration generators 50 and 140 consisted of moving coil vibration generators, but may also consist of moving iron vibration generators and piezo electric vibration generators. The spring members 58 and 148 for the vibration generators 50 and 140 may also consist of bellows.

The musical instruments that can be used for the working of the present invention are not limited to guitars and violins, but any other musical instruments having parts corresponding to the strings and the bridges. The present invention can also be used for seasoning and aging string instruments.

The various components described in conjunction with the foregoing embodiments are not entirely essential for the present invention, but can be appropriately substituted and omitted without departing from the spirit of the present invention.

The contents of the original Japanese patent application (JP2013-121936 filed Jun. 10, 2013) which serves as the basis for the Paris Convention priority claim made for this application are incorporated into this application by reference.

INDUSTRIAL APPLICABILITY

According to the present invention, sound can be emitted from a string instrument having an attractive appearance so that the listener can enjoy a pleasing visual and audio ambiance. Therefore, the present invention can be worked in both public and private environments, and is beneficial for both individuals and the public in wide.

GLOSSARY OF TERMS

1 guitar
3 front board
5 body
7 sound hole
9 string
11 bridge base member
13 bridge
15 bridge pin
20 vibrating device
22 base member
24 load point member
26 vibration transmission member
28 locating projection
30 fulcrum member
32 projection
34 support hole
36 support member
38 anchor member
40 lever cam
42 pivot pin
44 mushroom pin
50 vibration generator
52 permanent magnet
54 magnetic gap
56 yoke member
58 spring member
60 voice coil
62 disk
100 vibrating device
102 base member
108 vibration insulation sheet
110 support plate
116 vibration insulation sleeve
118 support rod
120 fulcrum member
122 rubber sheet
125 vibration transmission member
126 vibration insulation sleeve
130 anchor member
132 lever cam
140 vibration generator
142 permanent magnet
144 yoke member
146 support member
148 spring member
150 bobbin
152 vibration transmission member
154 voice coil
156 load point member
158 projection

The invention claimed is:

1. A device for vibrating a string instrument provided with a bridge, comprising:

a base member provided with a load point member that engages the bridge; and a vibration generator mounted on the base member and configured to convert an electric signal into a mechanical vibration;

wherein the base member includes a fulcrum member engaging an upper side of at least one string of the string instrument, an anchor member engaging a lower side of the at least one string at a point located between the load point member and the fulcrum member and a mechanism for displacing at least one of the fulcrum member and the anchor member in a direction to urge the load point member against the bridge.

2. The device according to claim 1, wherein the anchor member, the load point member and the fulcrum member are located along a length of the string.

3. The device according to claim 1, Wherein the base member is provided with a cam mechanism for pulling the anchor member upward.

4. The device according to claim 1, wherein the vibration generator and the load point member are located on one end of the base member and the fulcrum member is located on another end of the base member.

5. The device according to claim 1, wherein the anchor member comprises a rod member engaging at least two strings of the string instrument and extending along a direction perpendicular to an axial line connecting central parts of the load point member and the fulcrum member with each other.

6. The device according to claim 1, wherein the fulcrum member comprises a rod member engaging at least two strings of the string instrument and extending along a direction perpendicular to an axial line connecting central parts of the load point member and the fulcrum member with each other.

7. The device according to claim 1, wherein the base member comprises a locating portion provided adjacent to the load point member, the locating portion being configured to abut the bridge from a side of the fulcrum member in a lengthwise direction of the strings.

8. The device according to claim 1, wherein the load point member consists of a single projection.

9. The device according to claim 1, wherein the load point member consists of a pair of projections.

10. The device according to claim 1, wherein the vibration generator comprises a pair of vibration generators, one for high frequency range sound and the other for low frequency range sound, provided on either side of an axial extending between centers of the load point member and the fulcrum member.

11. The device according to claim 10, wherein the base member includes a pair of bifurcated parts that support the high frequency range vibration generator and the low frequency vibration generator, respectively, and the load point member is provided on each of the bifurcated parts.

12. The device according to claim 1, wherein the vibration generator comprises a vibration transmission member for transmitting a mechanical vibration to outside, and a first vibration insulation member for insulating vibrations between the vibration transmission member and the base member is provided between the vibration transmission member and the base member.

13. The device according to claim 1, wherein a second vibration insulation member for insulating vibrations between the base member and the fulcrum member is provided between the base member and the fulcrum member, and a third vibration insulation member for insulating vibrations between the base member and the anchor member is provided between the base member and the anchor member.

* * * * *